United States Patent [19]

Bayard

[11] 4,244,063

[45] Jan. 13, 1981

[54] THERAPEUTIC TOILET SEAT

[76] Inventor: Thomas Bayard, 1105 Seward St., Evanston, Ill. 60202

[21] Appl. No.: 76,488

[22] Filed: Sep. 17, 1979

[51] Int. Cl.[3] ..... A47K 13/00

[52] U.S. Cl. ..... 4/237; 4/234

[58] Field of Search ..... 4/237, 234

[56] References Cited

U.S. PATENT DOCUMENTS

| | | | |
|---|---|---|---|
| 2,069,301 | 2/1937 | Carlson | 4/237 |
| 2,256,994 | 9/1941 | Warshaw | 4/237 |
| 3,786,522 | 1/1974 | Kira et al. | 4/237 |
| 4,048,679 | 9/1977 | Garnett | 4/237 |
| 4,145,767 | 3/1979 | Ibel | 4/237 |
| 4,175,294 | 11/1979 | Boyd | 4/237 |
| 4,189,794 | 2/1980 | Alemán-Mucino | 4/237 |

*Primary Examiner*—Henry K. Artis

*Attorney, Agent, or Firm*—Mason, Kolehmainen, Rathburn & Wyss

[57] ABSTRACT

A toilet seat for inducing bowel movements including an elongated buttock supporting member having a general curvature to overlie a portion of a toilet bowl upper surface, said buttock supporting member having a buttock contacting upper surface including an inner portion of said upper surface and an outer portion of said upper surface, said inner portion contoured concavely over a portion of said buttock contacting upper surface, and said outer portion contoured convexly over a portion of said buttock contacting upper surface, said concave contoured portion defining a concave curvature defined by the outermost concave points of said buttock contacting surface, said concave curvature having a greater degree of curvature than the general curvature of said buttock supporting member.

10 Claims, 8 Drawing Figures

THERAPEUTIC TOILET SEAT

FIELD OF THE INVENTION

The present invention relates to toilet seats and more particularly to therapeutic toilet seats useful in inducing bowel movements.

As set forth in my prior U.S. Pat. No. 3,244,168, it is well recognized that physical stimulation of the buttocks is effective in relieving constipation, aiding to induce bowel movements and in aiding the release of intestinal gases. Such stimulation may serve to relax the anal sphincter and results in improved intestinal peristalsis. Such stimulation is important for bedfast patients, the adged, convalescent, and at times even persons with generally overall good health.

PRIOR ART

Recognizing the above need, massaging devices for stimulating the area adjacent the rectum and buttocks have been suggested, such as described in U.S. Pat. No. 3,004,534 and such as the colon manipulator, as described in U.S. Pat. No. 2,985,171. Further devices used for supporting the user's thighs have also been proposed, such as described in U.S. Pat. No. 2,598,577.

In my prior U.S. Pat. No. 3,244,168 a selective vibrating or oscillating toilet seat is described which includes movable members for spreading the buttocks of the user. In this prior patent it is the vibratory or oscillatory motion of the seat which is relied upon for spreading the buttocks. In accordance with the present invention, I have found that a toilet seat having a particular buttock contacting surface configuration will spread the buttocks and will provide contact with important portions of the body so that bowel movements are induced.

SUMMARY OF THE INVENTION

An object of the present invention is to provide a new and improved toilet seat device having a buttock contacting surface configuration useful in aiding the inducement of bowel movements.

Another object of the present invention is to provide a bowel movement inducing toilet seat having an inner buttock contacting concave curvature adapted to spread the buttocks and thereby induce bowel movements.

Another object of the present invention is to provide a toilet seat including a seat base portion having a plurality of buttock contacting ridges or humps to contact the sides of the buttocks behind the anus to apply pressure to crucial muscles and thereby induce bowel movements.

Another object of the present invention is to provide a toilet seat device capable of being conveniently attached to standard stud bolts already provided on common toilet bowls.

Another object of the present invention is to provide a toilet seat capable of being driven through eccentrics for producing vibratory motion or oscillatory motion for further inducing bowel movements.

These and other objects of the present invention will become apparent from the following description and the drawings in which:

DETAILED DESCRIPTION OF A PREFERRED EMBODIMENT

Figure 1:
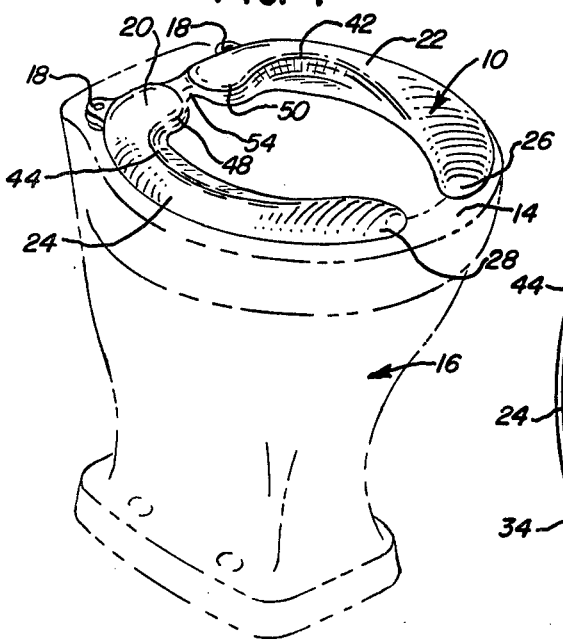
FIG. 1 is a plan view of a toilet seat constructed in accordance with the principles of the present invention showing the seat in position overlying a typical toilet bowl shown in dashed lines.

As shown in FIG. 1, a toilet seat 10 constructed in accordance with the principles of the present invention is disposed over an upper lip 14 of a toilet bowl 16 and the seat 10 is attached to the toilet bowl 16 at pivoting connection members 18. In accordance with the preferred embodiment shown in the drawing, the toilet seat 10 is generally U-shaped and includes a base 20 integrally connected to two generally curved leg members 22 and 24, having free ends 26 and 28, respectively. It is to be understood that the toilet seat 10 can fully encircle the upper lip 14 of toilet bowl 16 so that it is not necessary to provide the seat with free ends 26 and 28. Further, the toilet seat leg members 22 and 24 can be constructed as separate individually pivotable halves, so that it is not necessary that these leg members 22 and 24 are joined at the base 20.

Figure 5:
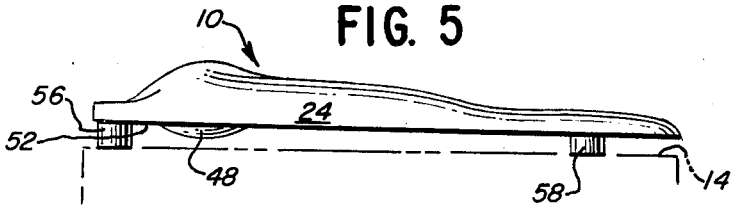
FIG. 5 is a side elevational view of the toilet seat constructed in accordance with the principles of the present invention, overlying a toilet bowl.
Figure 6:
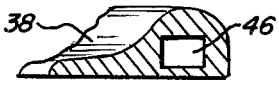
FIG. 6 is a plan, cross-sectional view of a portion of a toilet seat constructed in accordance with the principles of the present invention taken through the line 6—6 of FIG. 2.
Figure 7:
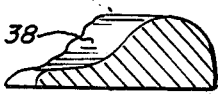
FIG. 7 is a plan cross-sectional view of a portion of a toilet seat constructed in accordance with the principles of the present invention taken through the line 7—7 of FIG. 2.
Figure 8:
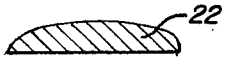
FIG. 8 is a cross-sectional view of a portion of a toilet seat constructed in accordance with the principles of the present invention taken through the line 8—8 of FIG. 2.

As best shown in FIG. 5, the uppermost surface of toilet seat 10 is sloped slightly downwardly toward the front of the toilet bowl 16 for providing better seating disposition for including bowel movements for the user and for providing more comfort when bowel movement inducement is needed.

Figure 2:
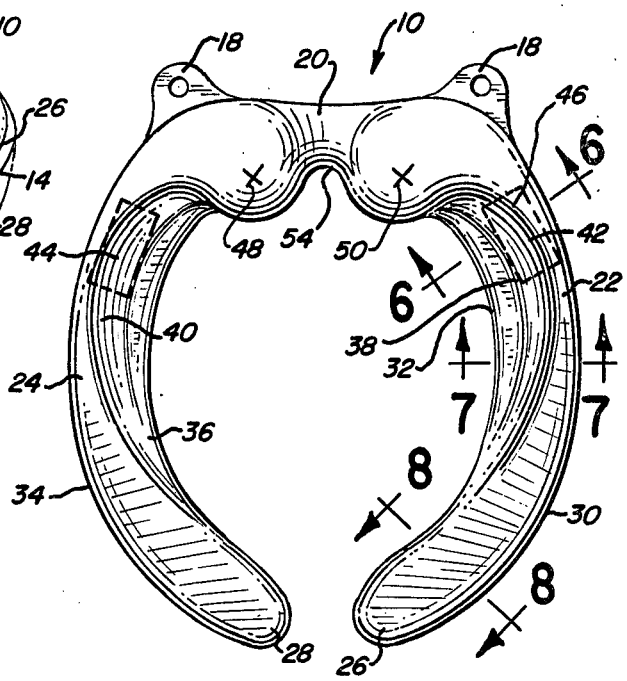
FIG. 2 is a top elevational view showing the toilet seat constructed in accordance with the principles of the present invention.

The seat legs 22 and 24 of toilet seat 10 are generally curved to overlie the upper lip 14 of toilet bowl 16. The general curvature of seat leg 22 is generally defined between the curvature of the outermost surface 30 and the innermost surface 32 of leg 22, as shown in FIG. 2. Similarly, the general curvature of toilet seat leg 24 is defined between the outermost surface 34 and the innermost surface 36 of leg 24, also shown in FIG. 2. The leg members 22 and 24 are integrally connected to base member 20 which is shaped to overlie a rear portion of toilet bowl lip 14.

In accordance with an important feature of the present invention, the toilet seat legs 22 and 24 are dished or concavely contoured over a portion of the inner buttocks contacting surface area as shown at 38 of leg 22 and as shown at 40 of leg 24, adjacent inner surfaces 32 and 36, respectively. It has been found that when the inner buttock contacting surfaces are dished or concavely contoured non-uniformly over a portion of the length of each leg 22 and 24, as best shown in FIG. 2, it is unnecessary to provide a vibrator or oscillator within the legs 22 and 24 or base 20. When the interior portion of the buttock contacting surfaces of legs 22 and 24 are dished or concavely contoured non-uniformly, as shown in FIG. 2, particularly when the degree of curvature of the concave portion, as represented by concave curvature lines 42 and 44 has a greater curvature than the general curvature of legs 22 and 24, the non-uniform concavity of the inner portion of the legs act to spread the buttocks without the necessity of vibratory or oscillatory action. It should be understood that, as shown in FIG. 2, vibrators or oscillators 46 can be installed within the toilet seat legs 22 and 24, as disclosed in my prior U.S. Pat. No. 3,244,168, the disclosure of which is hereby incorporated by reference. However, one of the main advantages of the design of the toilet seat 10 described herein is that the buttocks will be spread without the necessity for vibrators or oscillators 46.

Figure 3:
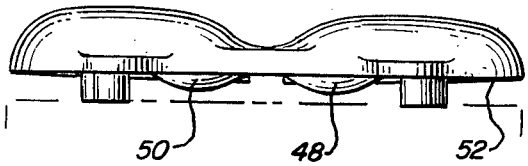
FIG. 3 is a rear-elevational view of the toilet seat constructed in accordance with the principles of the present invention.
Figure 4:
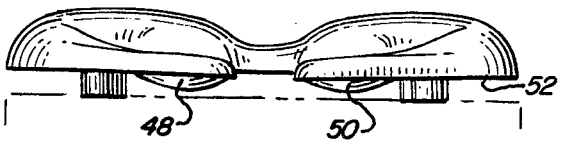
FIG. 4 is a front elevational view of the toilet seat constructed in accordance with the principles of the present invention.

In accordance with another important feature of the present invention, the toilet seat base 20 includes two downwardly extending ridges or humps 48 and 50 which extend below a plane defined by the bottom surface 52 of toilet seat 10, as best shown in FIGS. 3–5. These ridges or humps 48 and 50 extend downwardly to contact the sides of the buttocks behind the anus of the user to apply pressure to crucial muscles used in a bowel movement. The toilet seat 10 is effective by the user remaining in one position with ridges or humps 48 and 50 remaining in contact with these crucial muscles or the user can rock the buttocks to intermittently engage, or apply pressure to, these muscles from humps 48 and 50. Further, vibrators or oscillators (not shown) can be installed within humps 48 and 50 to provide automatic intermittent contact which, in some cases, is more effective than a constant contact by hump 48 and 50.

The seat 10 is effective when manufactured having only the concavely contoured portions 38 and 40 of the upper buttocks contacting surfaces or the seat is effective when manufactured having only the humps 48 and 50, but preferably the seat is manufactured having both the contoured concave portions 38 and 40 and the humps 48 and 50 for most effective inducement of bowel movements. In accordance with an important feature of the present invention, it has been found that the humps 48 and 50 interact quite effectively with the non-uniform concave contoured inner buttock contacting portions 38 and 40 to provide very effective and fast results in inducing bowel movements.

The concave or dished portions 38 and 40 of the inner surfaces 32 and 36 of the buttock contacting surfaces of toilet seat leg portions 22 and 24 extend over about 50 to about 75% of the length of inner surfaces 32 and 36 and this concave curvature is most severe near the base 20 of toilet seat 10 and tapers off gradually toward the front end of toilet seat 10. The outermost dished portions or concave portions of the inner buttock contacting surfaces defines the lines of curvature 42 and 44 and these lines of curvature 42 and 44 flow gently into the humps or ridges 48 and 50, respectively. The ridges 48 and 50 include a valley 54 therebetween and the ridges or humps 48 and 50 and the valley 54 are all convexly contoured. The convex humps 48 and 50 have found to be quite effective in inducing bowel movements when pressure is exerted on crucial muscles contacted by humps 48 and 50. The humps are generally rounded, convexly contoured members extending downwardly and spaced approximately two to four inches apart at their pressure most contact points, designated by x in FIG. 2. The pressure contact points x are disposed on an upper buttock contacting surface of the humps 48 and 50 approximately at the centers of the upper surfaces of humps 48 and 50.

The toilet seat 10 is disposed in a stable position to rest upon upper lip 14 of toilet seat 16 by being supported on intermediate spacers 56 and 58, as best shown in FIG. 5. Spacer 56 disposed near the base 20 of the toilet seat is higher than spacer 58 disposed more toward the front of the toilet seat so that the toilet seat 10 slopes generally and gradually downwardly toward the front of the toilet seat 16. Further, the upper buttock contacting surfaces of leg members 22 and 24 are generally sloped gradually downwardly toward the front of the toilet bowl 16 in that the seat 10 is generally thicker near the base 20 than near the front of the seat 10, as shown in FIG. 5. The upper buttock contacting surfaces of legs 22 and 24 are higher over the length of the dished or concave portion than over the remainder of the toilet seat as shown in FIG. 5. The greater height of the buttock contacting surfaces and generally the greater thickness of the toilet seat 10 over the length of the concave portions 38 and 40 allow for more surface area of the concave contoured portions 38 and 40, and thereby permit a greater degree of buttocks spreading as caused by the design of the toilet seat 10 disclosed herein. The outer portion of the legs 22 and 24 adjacent outermost surfaces 30 and 34 are contoured convexly to provide for user comfort and to aid in buttocks spreading in accentuating the concave lines of curvature 42 and 44 of the inner portions of legs 22 and 24. The points of greatest curvature along lines of curvature 42 and 44 along legs 22 and 24 define the thickest (highest) portion of leg members 22 and 24 to allow for greatest buttocks spreading over the greatest amount of concave inner buttock contacting surface area. To achieve the greatest bowel inducement when vibrators or oscillators 46 are installed (see FIG. 2), the vibrators or oscillators 46 are disposed directly below the point of greatest curvature in lines of curvature 42 and 44 of legs 22 and 24.

What is claimed as new and desired to be secured by Letters Patent of the United States is:

1. A toilet seat for inducing bowel movements including two elongated buttock supporting members having a general curvature to overlie a portion of a toilet bowl upper surface, each of said buttock supporting members having a buttock contacting upper surface including an inner portion of said upper surface and an outer portion of said upper surface, said inner portion contoured concavely over a portion of said buttock contacting upper surface, and said outer portion contoured convexly over a portion of said buttock contacting upper surface, said concave contoured portion defining a concave curvature defined by the outermost concave points of said buttock contacting surface, said concave curvature having a greater degree of curvature than the general curvature of said buttock supporting member, said toilet seat including a base portion disposed between and interconnecting said buttock supporting members, said base portion having two generally rounded protruding buttock contacting ridges extending inwardly and downwardly from said toilet seat base portion for applying pressure to muscles used in a bowel movement, said concave curvature of said buttock supporting members being shaped to flow gently into the generally rounded curvature of said buttock contacting ridges.

2. A toilet seat as defined in claim 1 wherein said buttock contacting support member has a front end and a rear end, and wherein said concave curvature is curved to a greater degree near said rear end than said front end.

3. A toilet seat as defined in claim 2 wherein said concave curvature curves relatively sharply from near said rear end over less than half of the length of the buttock supporting member, and curves relatively gradually thereafter, therefrom toward said front end.

4. A toilet seat as defined in claim 2 wherein said concave curvature does not extend over the complete length of said buttock supporting member.

5. A toilet seat as defined in claim 4 wherein said concave curvature extends over about 50% to about 85% of the length of a leg portion of said buttock contacting surface.

6. A toilet seat as defined in claim 5 wherein each of said leg members includes an upper buttock contacting surface having an outer convex portion disposed, when seat is disposed in a stable position overlying a toilet bowl, between a highest line of said buttock contacting surface and an outer leg surface and having a concave portion disposed between a generally highest line of said buttock contacting surface and an inner surface of said leg member.

7. A toilet seat as defined in claim 5 wherein each of said leg members has an upper buttock contacting surface generally sloped downwardly from said base toward said free end.

8. A toilet seat as defined in claim 7 wherein said leg members comprise a generally flat lower surface adapted to be supported on an upper surface of a toilet bowl, such that when supported on said toilet bowl, said lower surface is inclined downwardly from said base toward said free ends of said leg members.

9. A toilet seat as defined in claim 5 wherein said leg members are curved to generally correspond to the curvature of said toilet bowl and wherein said ridges extend downwardly below a plane in which said flat lower surface lies.

10. A method of defecating comprising disposing the buttocks in contact with and overlying a toilet seat and releasing the anal sphincter muscle to a degree sufficient to permit the discharge of feces from the body, wherein said toilet seat comprises two elongated buttock supporting members having a general curvature to overlie a portion of a toilet bowl upper surface, each of said buttock supporting members having a buttock contacting upper surface including an inner portion of said upper surface and an outer portion of said upper surface, said inner portion contoured concavely over a portion of said buttock contacting upper surface, and said outer portion contoured convexly over a portion of said buttock contacting upper surface, said concave contoured portion defining a concave curvature defined by the outermost concave points of said buttock contacting surface, said concave curvature having a greater degree of curvature than the general curvature of said buttock supporting member, said toilet seat including a base portion disposed between and interconnecting said buttock supporting members, said base portion having two generally rounded protruding buttock contacting ridges extending inwardly and downwardly from said toilet seat base portion for applying pressure to muscles used in a bowel movement, said concave curvature of said buttock supporting members being shaped to flow gently into the generally rounded curvature of said buttock contacting ridges.

* * * * *